US008387819B2

(12) United States Patent
Chu et al.

(10) Patent No.: US 8,387,819 B2
(45) Date of Patent: Mar. 5, 2013

(54) CARBONATED BEVERAGE CONTAINER

(76) Inventors: Ashleigh Ka Ying Chu, Hong Kong (HK); Nga Man Cheng, Hong Kong (HK); Chung Man Shum, Hong Kong (HK)

( * ) Notice: Subject to any disclaimer, the term of this patent is extended or adjusted under 35 U.S.C. 154(b) by 189 days.

(21) Appl. No.: 12/854,178

(22) Filed: Aug. 11, 2010

(65) Prior Publication Data

US 2011/0192855 A1 Aug. 11, 2011

Related U.S. Application Data

(60) Provisional application No. 61/303,320, filed on Feb. 11, 2010.

(51) Int. Cl.
*B65D 6/18* (2006.01)

(52) U.S. Cl. ..... 220/666; 215/900

(58) Field of Classification Search ..... 220/666; 215/900; 206/579
See application file for complete search history.

(56) References Cited

U.S. PATENT DOCUMENTS 3,160,323 A * 12/1964 Weisberg ..... 222/107
3,301,293 A * 1/1967 Santelli ..... 220/666
7,048,132 B2 * 5/2006 Yamanaka et al. ..... 215/381

* cited by examiner

*Primary Examiner* — Stephen Castellano

(57) ABSTRACT

A carbonated beverage container includes a bottle having a flexible sidewall of generally circular cross section, a cap for closing a top opening of the bottle, pairs of coupling elements provided on diametrically opposite portions of the sidewall respectively and configured to be pushed towards each other and couple together, thereby partially collapsing the bottle and expelling a predetermined amount of air therefrom. A method of preserving the taste of carbonated beverage in a container is also disclosed.

13 Claims, 3 Drawing Sheets

CARBONATED BEVERAGE CONTAINER

CROSS-REFERENCE TO RELATED APPLICATIONS

This application claims priority of U.S. provisional application No. 61/303,320 filed on Feb. 11, 2010, the entire content of which is hereby incorporated by reference.

BACKGROUND

The present application relates to a carbonated beverage container and a method of preserving the taste of a carbonated beverage in a carbonated beverage container.

Carbonated beverages such as Coca-Cola™ are becoming more popular. Many families would buy family size bottles to satisfy the need of the entire family. However, the taste of carbonated beverage inside the bottle would change quite easily after the carbonated beverage bottle is open and stored in a refrigerator after a few days.

One existing method of solving the problem is the use of a Fizz Keeper. The Fizz Keeper is a pump connectable to a bottle neck to pump air into the bottle thereby increasing the pressure inside the bottle and keeping the amount of carbon dioxide inside the bottle. However, one disadvantage of this method is that it requires a user to pump air into the bottle many times and generate great pressure inside the bottle in order to prevent the escape of carbon dioxide from the bottle. Furthermore, it has been shown that the effect of Fizz Keeper can only last for a few hours.

The above description of the background is provided to aid in understanding a carbonated beverage container, but is not admitted to describe or constitute pertinent prior art to the carbonated beverage container disclosed in the present application, or consider any cited documents as material to the patentability of the claims of the present application.

SUMMARY

According to one aspect, there is provided a carbonated beverage container including:

a body having a flexible sidewall; and a first pair of coupling elements provided on first and second portions of the sidewall respectively and configured to be pushed towards each other and couple together, thereby partially collapsing the body and expelling a predetermined amount of air therefrom.

In one embodiment, the sidewall is generally circular in cross section, and the first pair of coupling elements is provided on two diametrically opposite portions of the sidewall respectively.

In one embodiment, the first pair of coupling elements is in the form of a pair of socket and stud buttons.

In one embodiment, the first pair of coupling elements is in the form of a pair of hooks.

In one embodiment, the first pair of coupling elements is in the form of a ring and an L-shaped hook.

In one embodiment, the first pair of coupling elements is in the form of a buckle.

In one embodiment, the first pair of coupling elements is provided at an upper portion of the body.

In one embodiment, the first pair of coupling elements is integrally formed on the body.

The carbonated beverage container further includes a cap for closing an opening of the body.

The carbonated beverage container further includes a first marking on the sidewall to indicate a suitable time for coupling the first pair of coupling elements together when beverage level drops to the first marking.

The carbonated beverage container further includes a second pair of coupling elements provided on third and fourth portions of the sidewall respectively and configured to be pushed towards each other and couple together, thereby further collapsing the body and expelling a further predetermined amount of air therefrom.

The carbonated beverage container further includes a second marking on the sidewall below the first marking to indicate a suitable time for coupling the second pair of coupling elements together when beverage level drops to the second marking.

In one embodiment, coupling the first pair of coupling elements together of a 1.25 liter body expels 600 ml of air from the body, and further coupling the second pair of coupling elements together expels a further 300 ml of air from the body.

The carbonated beverage container further includes a third pair of coupling elements provided on fifth and sixth portions of the sidewall respectively and configured to be pushed towards each other and couple together, thereby further collapsing the body and expelling a further predetermined amount of air therefrom.

The carbonated beverage container further includes a third marking on the sidewall below the second marking to indicate a suitable time for coupling the third pair of coupling elements together when beverage level drops to the third marking.

In one embodiment, the first, second and third markings are in the form of calibration lines.

In one embodiment, each of the first, second and third markings is in the shape of a triangle.

In one embodiment, each of the first, second and third markings is in the shape of a finger.

According to another aspect, there is provided a method of preserving the taste of a carbonated beverage inside a container having a flexible sidewall, the method including the steps of:

providing a first pair of coupling elements on first and second portions of the sidewall respectively;

pushing the first pair of coupling elements towards each other; and coupling the first pair of coupling elements together, thereby partially collapsing the body of the container and expelling a predetermined amount of air therefrom.

The method further includes the step of provided a first marking on the sidewall, and pushing the first pair of coupling elements towards each other and coupling them together when beverage level drops to the first marking.

The method further includes the steps of:

providing a second pair of coupling elements on third and fourth portions of the sidewall respectively;

pushing the second pair of coupling elements towards each other; and coupling the second pair of coupling elements together, thereby further collapsing the body of the container and expelling a further predetermined amount of air therefrom.

The method further includes the step of provided a second marking on the sidewall, and pushing the second pair of coupling elements towards each other and coupling them together when beverage level drops to the second marking.

In one embodiment, coupling the first pair of coupling elements together of a 1.25 liter body expels 600 ml of air from the body, and further coupling the second pair of coupling elements together expels a further 300 ml of air from the body.

The method further includes the steps of:

providing a third pair of coupling elements on fifth and sixth portions of the sidewall respectively;

pushing the third pair of coupling elements towards each other; and coupling the third pair of coupling elements together, thereby further collapsing the body of the container and expelling a further predetermined amount of air therefrom.

The method further includes the step of provided a third marking on the sidewall, and pushing the third pair of coupling elements towards each other and coupling them together when beverage level drops to the third marking.

Although the carbonated beverage container disclosed in the present application is shown and described with respect to certain embodiments, it is obvious that equivalents and modifications will occur to others skilled in the art upon the reading and understanding of the specification. The present application includes all such equivalents and modifications, and is limited only by the scope of the claims.

BRIEF DESCRIPTION OF THE DRAWINGS

Specific embodiments of the carbonated beverage container disclosed in the present application will now be described by way of example with reference to the accompanying drawings wherein.

DETAILED DESCRIPTION

Reference will now be made in detail to a preferred embodiment of the carbonated beverage container disclosed in the present application, examples of which are also provided in the following description. Exemplary embodiments of the carbonated beverage container disclosed in the present application are described in detail, although it will be apparent to those skilled in the relevant art that some features that are not particularly important to an understanding of the carbonated beverage container may not be shown for the sake of clarity.

Furthermore, it should be understood that the carbonated beverage container disclosed in the present application is not limited to the precise embodiments described below and that various changes and modifications thereof may be effected by one skilled in the art without departing from the spirit or scope of the appended claims. For example, elements and/or features of different illustrative embodiments may be combined with each other and/or substituted for each other within the scope of this disclosure and appended claims.

Figure 1:
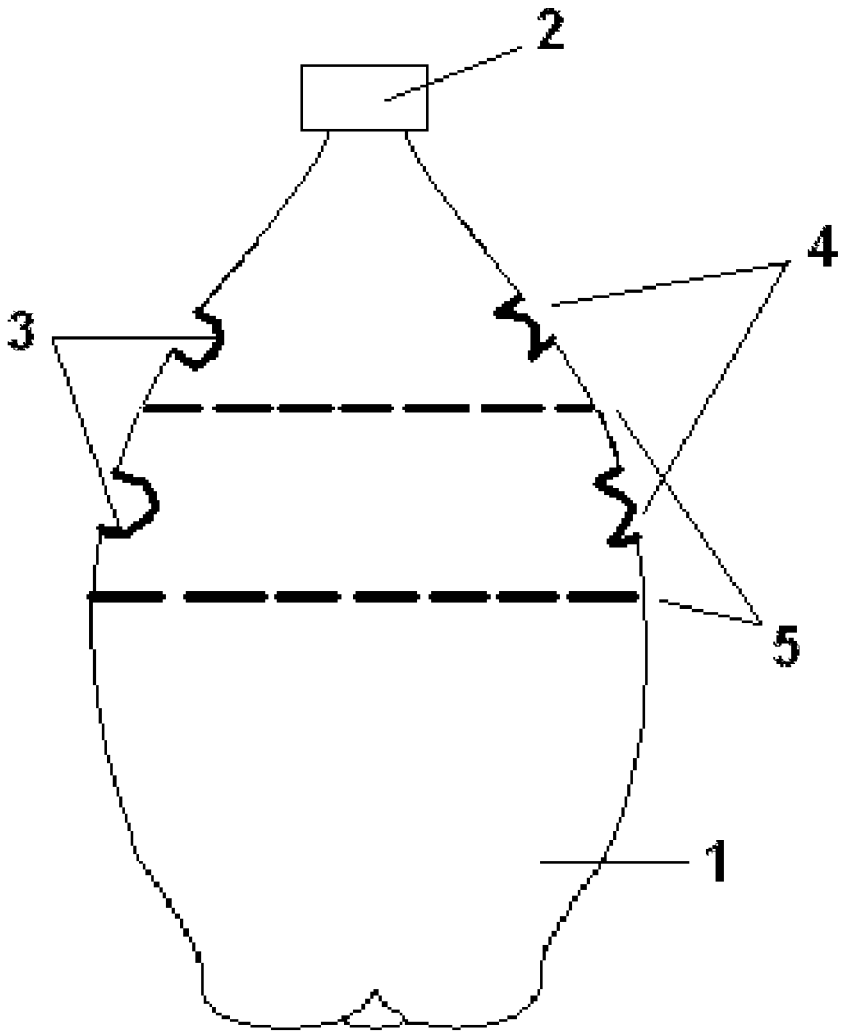
FIG. 1 is an illustrative diagram of a side view of a carbonated beverage container according to an embodiment disclosed in the present application.

FIG. 1 is an illustrative diagram of a side view of a carbonated beverage container according to an embodiment disclosed in the present application. The carbonated beverage container may include a container bottle or body 1, a cap 2, a first coupling element 3 and a second coupling element 4. The body 1 has a flexible sidewall of generally circular cross section. The body 1 may have a top beverage-dispensing opening. The cap 2 is employed to close the beverage-dispensing opening of the body 1. The first and second coupling elements 3, 4 can be provided respectively on first and second portions of the sidewall of the body 1. According to the illustrated embodiment, the first and second coupling elements 3, 4 are provided on diametrically opposite first and second portions of the sidewall respectively. The first and second coupling elements 3, 4 are so configured that they can be pushed towards each other and couple together. When the first and second coupling elements 3, 4 are coupled together, the body 1 is partially collapsed and a predetermined amount of air above the beverage is expelled from the body. According to an embodiment, the first and second coupling elements 3, 4 can be integrally formed on the container body 1. The first and second coupling elements 3, 4 can be integrally formed on the body 1 by any conventional molding process, such as a melted plastic cast molding process.

Figure 2:
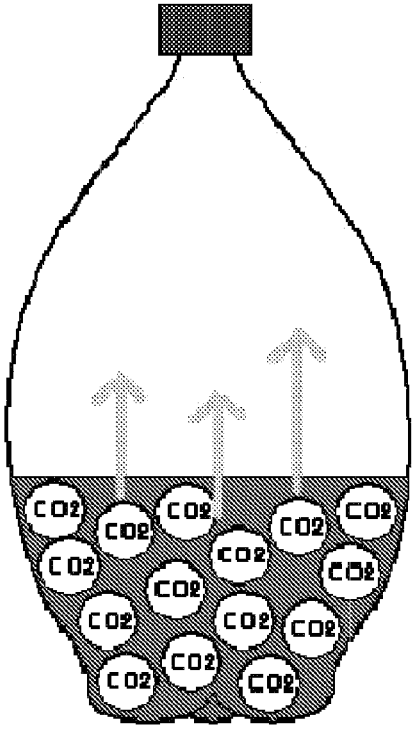
FIG. 2 is an illustrative diagram showing carbon dioxide inside the carbonated beverage of the carbonated beverage container.

FIG. 2 is an illustrative diagram showing carbon dioxide inside the carbonated beverage of the carbonated beverage container. When there is a space inside the carbonated beverage container above the beverage, the carbon dioxide dissolved inside the carbonated beverage has a tendency to move from the carbonated beverage into the air above the carbonated beverage, as shown by the arrows.

Figure 3:
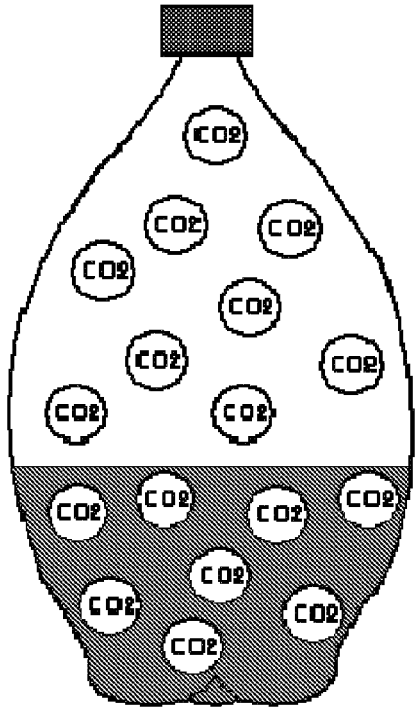
FIG. 3 is an illustrative diagram showing the escape of carbon dioxide from the carbonated beverage into the space within the upper portion of the carbonated beverage container.

FIG. 3 is an illustrative diagram showing the escape of carbon dioxide from the carbonated beverage into the headspace within the upper portion of the carbonated beverage container. When an equilibrium is reached, no more carbon dioxide can move from the carbonated beverage into the air above the beverage.

Figure 4:
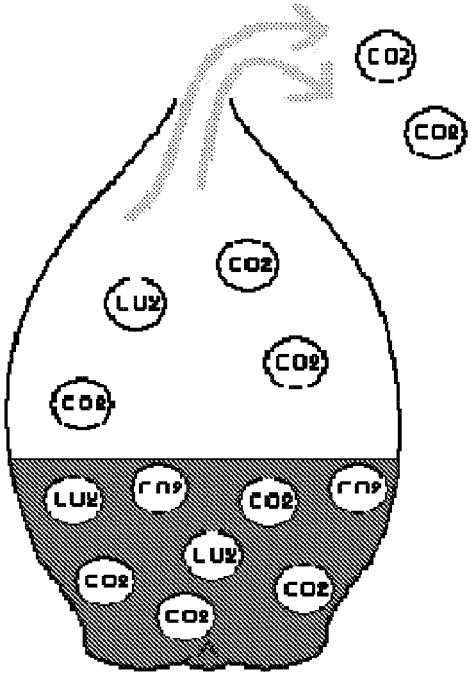
FIG. 4 is an illustrative diagram showing the escape of carbon dioxide from the space within the upper portion of the carbonated beverage container into the outside atmosphere when the cap is removed for the dispensing of the carbonated beverage from the carbonated beverage container.

FIG. 4 is an illustrative diagram showing the escape of carbon dioxide from the headspace within the upper portion of the carbonated beverage container into the outside atmosphere when the cap is removed for dispensing of carbonated beverage from the carbonated beverage container. This occurs because of the difference of pressure between the air inside the carbonated beverage container and the outer atmosphere.

Figure 5:
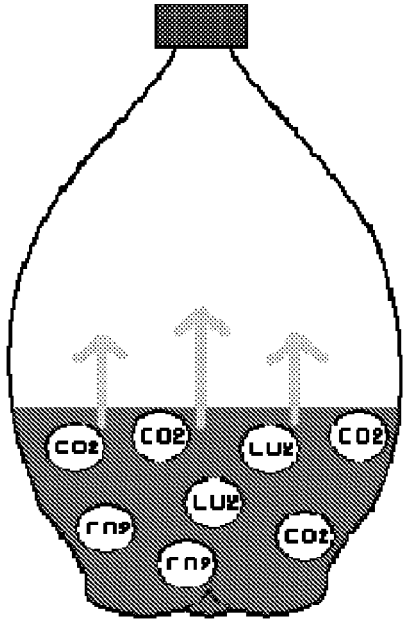
FIG. 5 is an illustrative diagram showing a reduction of carbon dioxide inside carbonated beverage as compared to the amount of carbon dioxide initially inside the carbonated beverage in the carbonated beverage container of FIG. 2.

FIG. 5 is an illustrative diagram showing a reduction of carbon dioxide inside carbonated beverage as compared to the amount of carbon dioxide initially inside the carbonated beverage in the carbonated beverage container of FIG. 2. When the dispensing of the carbonated beverage from the carbonated beverage container is repeated, the amount of carbon dioxide inside the carbonated beverage becomes less and less.

Figure 6:
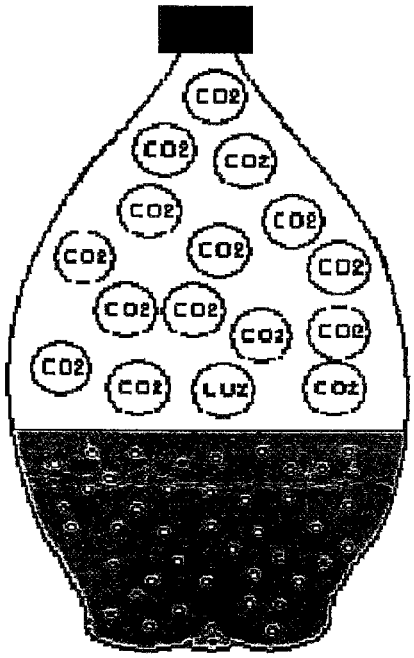
FIG. 6 is an illustrative diagram showing the amount of carbon dioxide in the space within the upper portion of the carbonated beverage container.

FIG. 6 is an illustrative diagram showing the amount of carbon dioxide in the air within the upper portion of the carbonated beverage container. The escape of carbon dioxide into the headspace above the beverage can be prevented by coupling of the first and second coupling elements 3, 4 together.

Figure 7:
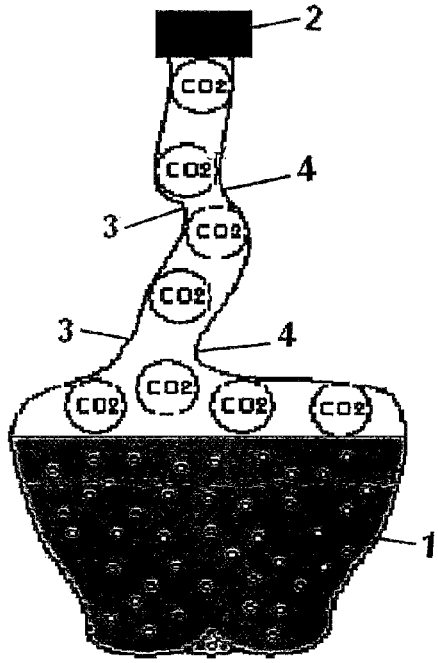
FIG. 7 is an illustrative diagram showing the reduction of carbon dioxide in the space within the upper portion of the carbonated beverage container when the container is collapsed and the space is reduced after the coupling elements of the present application are coupled together.

FIG. 7 is an illustrative diagram showing the reduction of carbon dioxide in the air within the upper portion of the carbonated beverage container when the container is partially collapsed and the amount of air is expelled after the coupling elements 3, 4 of the present application are coupled together. Less carbon dioxide would escape from the carbonated beverage into the air above in order to reach an equilibrium stage.

The coupling of the first and second coupling elements 3, 4 together is easy to perform. By coupling the first and second coupling elements 3, 4 together and expelling the air above the beverage, the taste of the carbonated beverage inside the carbonated beverage container can be effectively preserved for a longer period of time.

Therefore, once the carbonated beverage container is opened, one can place the container inside a refrigerator so that the taste of the carbonated beverage remaining inside the container could not be easily changed. This can avoid the situation where the taste of the carbonated beverage inside the container has changed and the unconsumed carbonated beverage inside the carbonated beverage container needs to be discarded and wasted. According to experiments, the carbonated beverage container of the present application can effectively keep the carbon dioxide inside the carbonated beverage for a few days.

Since the carbonated beverage container of the present application is partially collapsed when the first and second coupling elements 3, 4 are coupled together, it can substantially reduce the space in a recycling bin required for recycling these carbonated beverage containers of the present application. Therefore, the use of these carbonated beverage containers of the present application can increase the number of containers to be collected by a recycling bin and can therefore be more environmental-friendly.

The manufacturing of the carbonated beverage container of the present application is not expensive. One can only modify the molds for manufacturing the container once and the molds are ready for mass production of the container.

According to the illustrated embodiment in FIG. 1, the carbonated beverage container may include a marking 5 which corresponds to the first and second coupling elements 3, 4. When the beverage level insider the carbonated beverage container drops to the marking 5, this indicates that it is a suitable time to couple the first and second coupling elements 3, 4 together so as to expel the air from the body 1. This can avoid the coupling of the first and second coupling elements 3, 4 together when there is not enough space above the beverage causing spilling of carbonated beverage out of the carbonated beverage container. According to the embodiment in FIG. 1, the markings 5 are one below the other in the form of calibration lines. It is understood that the marking 5 can be in any other appropriate forms including but is not limited to the shape of a finger or a triangle.

According to the illustrated embodiment in FIG. 1, there are two pairs of coupling elements 3, 4 and two corresponding markings 5. Each marking 5 corresponds to one pair of coupling elements 3, 4. The number of pair of coupling elements 3, 4 may vary depending on the size of the carbonated beverage container. For example, a 1.25 liter carbonated beverage container may have two pairs of coupling elements 3, 4 and two corresponding markings 5. A 2-liter carbonated beverage container may have three pairs of coupling elements 3, 4 and three corresponding markings 5. According to experiments with a 1.25-liter carbonated beverage container having two pairs of coupling elements 3, 4, the coupling of the first pair of coupling elements 3, 4 together can expel 600 ml of air from the container, and the coupling of the second pair of coupling elements 3, 4 together can further expel 300 ml of air from the container.

As shown in FIG. 1, the first and second coupling elements 3, 4 are in the form of a pair of socket and stud buttons. One of the buttons has a stud and the other one of the buttons has a socket. The first and second coupling elements 3, 4 can be coupled together by inserting and snapping the stud of the one button into the socket of the other button. The coupling of the first and second coupling elements 3, 4 cannot be easily released and the container can be maintained in the collapsed configuration. Since the carbonated beverage container of the present application can be manufactured by the conventional melted plastic cast molding process, the socket and stud can be formed on the two molds for the container respectively.

Figure 8:
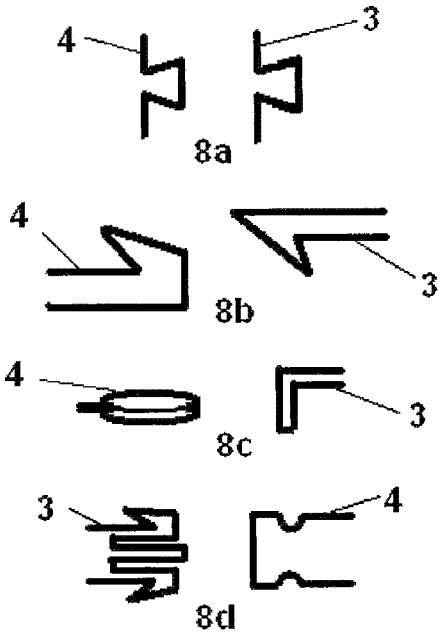
FIG. 8*a* shows a first embodiment of the pair of coupling elements formed on the carbonated beverage container.
FIG. 8*b* shows a second embodiment of the pair of coupling elements formed on the carbonated beverage container.
FIG. 8*c* shows a third embodiment of the pair of coupling elements formed on the carbonated beverage container.
FIG. 8*d* shows a fourth embodiment of the pair of coupling elements formed on the carbonated beverage container.

FIGS. 8*a* to 8*d* show different embodiments of the first and second coupling elements 3, 4. FIG. 8*a* shows a pair of coupling elements 3, 4 in the form of a pair of snap buttons of different shapes. The first coupling element 3 can be in the form of a dove-tail shaped recess whereas the second coupling element 4 can be in the form of a matching dove-tail shaped projection. When the snap buttons are pushed towards each other, the dove-tail shaped projection of one snap button is adapted to be inserted and snapped into the dove-tail shaped recess of the other snap button so that the two buttons can be coupled together.

FIG. 8*b* shows a pair of coupling elements 3, 4 in the form of a pair of hooks configured to interlock with each other. When the two hooks are pushed towards each other, the first hook is adapted to hook onto the second hook so that the two hooks can be interlocked with each other even under great pressure inside the collapsed container.

FIG. 8*c* shows a pair of coupling elements 3, 4 in the form of an L-shaped hook and a ring. The first coupling element 3 takes the form of an L-shaped hook and the second coupling element 4 takes in the form of a ring with an opening. When the L-shaped hook and the ring are pushed towards each other, the one arm of the L-shaped hook is adapted to insert into the opening of the ring so that the L-shaped hook and the ring can be interlocked with each other even under great pressure inside the collapsed container.

FIG. 8*d* shows a pair of coupling elements 3, 4 in the form of a buckle. The first coupling element 3 is in the form of a first buckle member having two snap-fit hooks, and the second coupling element 4 is in the form of a second buckle member having two openings for engaging and snap-fitting with the two snap-fit hooks respectively. When the two buckle members are pushed towards each other, the two snap-fit hooks are adapted to snap-fit to the two openings respectively so that the two buckle members can be interlocked with each other even under great pressure inside the collapsed container.

It is appreciated that the pair of coupling elements 3, 4 such as those in FIG. 8*a* can be formed integrally on the bottle. The pair of coupling elements 3, 4 such as those in FIG. 8*d* may be separately formed and provided on the body.

Although it has been shown and described that the pair of coupling elements 3, 4 are provided on diametrically opposite portions of the sidewall, it is understood by one skilled in the art that the pair of coupling elements 3, 4 can be provided on any other possible portions of the sidewall to collapse the bottle in other possible ways. For example, the pair of coupling elements 3, 4 can be provided one on top of the other such that it is possible for the bottle to be collapsed vertically.

Although it has been shown in FIG. 1 that the two pairs of coupling elements 3, 4 are oriented on the same opposite sides of the sidewall, it is possible that different pairs of coupling elements 3, 4 may have different orientations on the sidewall with respect to each other.

The carbonated beverage container disclosed in the present application can preserve the taste of the carbonated beverage inside the container for a longer period of time. Since the carbonated beverage container can increase the period for preserving the carbonated beverage inside the container, this can attract more consumers to buy the 1.25 liter and 2-liter carbonated beverage containers. Hence, the sale of the 1.25 liter and 2-liter carbonated beverage containers will increase.

In view of the fact that modifying the molds for manufacturing the container once and the molds are ready for mass production, the manufacturing cost of the carbonated beverage container of the present application is relatively low.

While the carbonated beverage container disclosed in the present application has been shown and described with particular references to a number of preferred embodiments thereof, it should be noted that various other changes or modifications may be made without departing from the scope of the appending claims.

What is claimed is:

1. A carbonated beverage container comprising:

a body having a flexible sidewall; and a first pair of coupling elements provided on first and second portions of the sidewall respectively and configured to be pushed towards each other and couple together, thereby partially collapsing the body and expelling a predetermined amount of air therefrom;

wherein the first pair of coupling elements is in the form of a pair of socket and stud buttons.

2. The carbonated beverage container as claimed in claim 1, wherein the sidewall is generally circular in cross section, and the first pair of coupling elements is provided on two diametrically opposite portions of the sidewall respectively.

3. The carbonated beverage container as claimed in claim 1, wherein the first pair of coupling elements is provided at an upper portion of the body.

4. The carbonated beverage container as claimed in claim 1, wherein the first pair of coupling elements is integrally formed on the body.

5. The carbonated beverage container as claimed in claim 1, further comprising a cap for closing an opening of the body.

6. The carbonated beverage container as claimed in claim 1, further comprising a first marking on the sidewall to indicate a suitable time for coupling the first pair of coupling elements together when beverage level drops to the first marking.

7. The carbonated beverage container as claimed in claim 6, further comprising a second pair of coupling elements provided on third and fourth portions of the sidewall respectively and configured to be pushed towards each other and couple together, thereby further collapsing the body and expelling a further predetermined amount of air therefrom.

8. The carbonated beverage container as claimed in claim 7, further comprising a second marking on the sidewall below the first marking to indicate a suitable time for coupling the second pair of coupling elements together when beverage level drops to the second marking.

9. The carbonated beverage container as claimed in claim 8, wherein coupling the first pair of coupling elements together of a 1.25 liter body expels 600 ml of air from the body, and further coupling the second pair of coupling elements together expels a further 300 ml of air from the body.

10. The carbonated beverage container as claimed in claim 7, wherein the first, and second markings are in the form of calibration lines.

11. The carbonated beverage container as claimed in claim 7, wherein each of the first and second markings is in the shape of a finger.

12. A carbonated beverage container comprising:

a bottle having a flexible sidewall of generally circular cross section;

a cap for closing a top opening of the bottle;

a first pair of coupling elements provided on diametrically opposite first and second portions of the sidewall respectively and configured to be pushed towards each other and couple together, thereby partially collapsing the bottle and expelling a predetermined amount of air therefrom;

a first marking provided on the sidewall to indicate a suitable time for coupling the first pair of coupling elements together when beverage level drops to the first marking;

a second pair of coupling elements provided on diametrically opposite third and fourth portions of the sidewall respectively and configured to be pushed towards each other and couple together, thereby further collapsing the bottle and expelling a further predetermined amount of air therefrom;

a second marking provided on the sidewall below the first marking to indicate a suitable time for coupling the second pair of coupling elements together when beverage level drops to the second marking;

wherein coupling the first pair of coupling elements together of a 1.25 liter bottle expels 600 ml of air from the bottle, and further coupling the second pair of coupling elements together expels a further 300 ml of air from the bottle.

13. The carbonated beverage container as claimed in claim 12, wherein the first pair of coupling elements is in the form of a pair of socket and stud buttons.

* * * * *